US006762670B1

(12) United States Patent
Yen

(10) Patent No.: US 6,762,670 B1
(45) Date of Patent: Jul. 13, 2004

(54) FUSE APPARATUS WITH EXPLOSION-PROOF STRUCTURE

(76) Inventor: Chun-Chang Yen, No. 8, Lane 247, Neu Pu Road, Hsinchu City (TW)

( * ) Notice: Subject to any disclaimer, the term of this patent is extended or adjusted under 35 U.S.C. 154(b) by 0 days.

(21) Appl. No.: 10/410,359

(22) Filed: Apr. 10, 2003

(51) Int. Cl.[7] ..... H01H 85/43
(52) U.S. Cl. ..... 337/203; 337/249
(58) Field of Search ..... 337/186, 203, 337/249, 250, 281; 29/623

(56) References Cited

U.S. PATENT DOCUMENTS

| | | | | | |
|---|---|---|---|---|---|
| 426,156 | A | * | 4/1890 | Warrell | 337/203 |
| 588,686 | A | * | 8/1897 | Marshall | 337/281 |
| 629,663 | A | * | 7/1899 | Davis | 337/203 |
| 1,070,452 | A | * | 8/1913 | Griffin | 337/203 |
| 1,239,876 | A | * | 9/1917 | Burnham | 337/188 |
| 1,475,558 | A | * | 11/1923 | Appleton | 337/263 |
| 1,779,697 | A | * | 10/1930 | Glowacki | 337/243 |
| 1,907,266 | A | * | 5/1933 | Mills | 337/10 |
| 3,469,047 | A | * | 9/1969 | Berg et al. | 218/48 |
| 5,179,436 | A | * | 1/1993 | Asdollahi et al. | 337/203 |
| 5,287,079 | A | * | 2/1994 | Bernardi et al. | 337/203 |
| 5,783,987 | A | * | 7/1998 | Kern et al. | 337/401 |
| 6,542,063 | B2 | * | 4/2003 | Kawashima et al. | 337/203 |

* cited by examiner

*Primary Examiner*—Anatoly Vortman
(74) *Attorney, Agent, or Firm*—Rosenberg, Klein & Lee

(57) ABSTRACT

The present invention relates to a fuse apparatus with explosion-proof structure, which includes a connector connecting with two conductive legs, a fuse mounted on the connector, and a cap covering the connector. The characteristic is to provide a horizontal hole and a vertical aperture in the connector that becomes a T-shape vent passageway at upside-down position. And the connector is provided with two sets of side protrusions, which form a gap between the opening of the horizontal hole of the connector and the cap when the cap covers the connector to release high pressure in the cap when the fuse is accidentally broken. The improved fuse apparatus is safer, since the explosion is prevented.

1 Claim, 3 Drawing Sheets

FUSE APPARATUS WITH EXPLOSION-PROOF STRUCTURE

BACKGROUND OF THE INVENTION

The present invention refers to a fuse apparatus, which includes an improved structure for preventing an explosion when the fuse is blown out.

As shown in FIGS. 1 and 2, a conventional sub-miniature fuse apparatus includes a connector (1) to connect with two conductive legs (11) for being mounted on an IC board. A fuse (2) is provided on the connector (1) and is contacted with top end of the conductive leg (11). A cap (3) covers the connector (1) and the fuse (2) is sealed therein. As the fuse (2) is broken, there will be occurred an instant high pressure. It is very possible that the cap (3) will explode. The other means on the IC board could be damaged because of this explosion. U.S. Pat. No. 5,287,079, discloses a sub-miniature plastic fuse, which is provided with at least one vent passageway formed in the periphery base extending from top surface of the base to an opening below. Since the vent passageway has a downward opening, dust or other object would be possibly introduced into the fuse, that will affect the effectiveness of the device.

In order to solve this drawback, the present invention mainly provides an improved fuse apparatus, which includes a T-shape vent passageway formed in the connector. The improved vent passageway can release the pressure occurred in the cap, which is then prevented from breakage during explosion.

BRIEF DESCRIPTION OF THE DRAWINGS

The following drawings indicate the character and improvement of the fuse apparatus of the present invention.

DETAILED DESCRIPTION OF THE INVENTION

Figure 1:
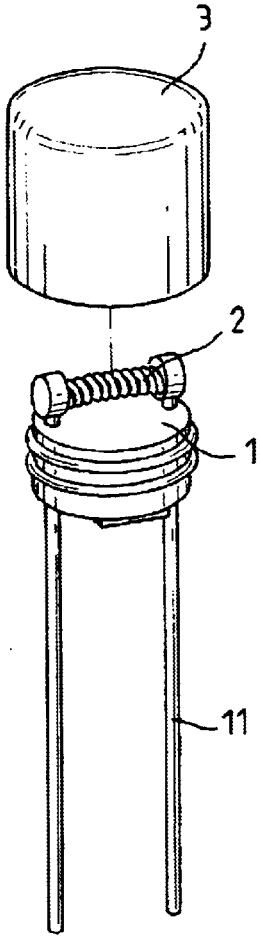
FIG. 1 (prior art)
FIG. 1 shows an exploded perspective view of a conventional sub-miniature fuse apparatus.
Figure 2:
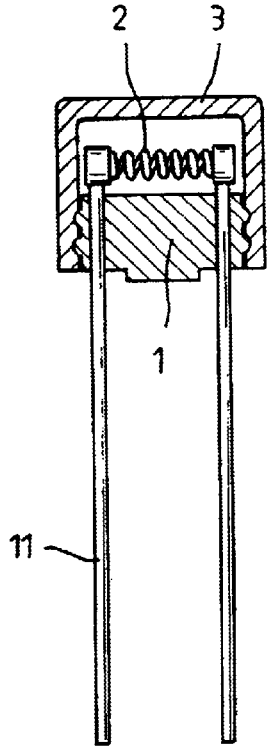
FIG. 2 (prior art)
FIG. 2 shows an assembled plan view of the fuse apparatus of FIG. 1.
Figure 3:
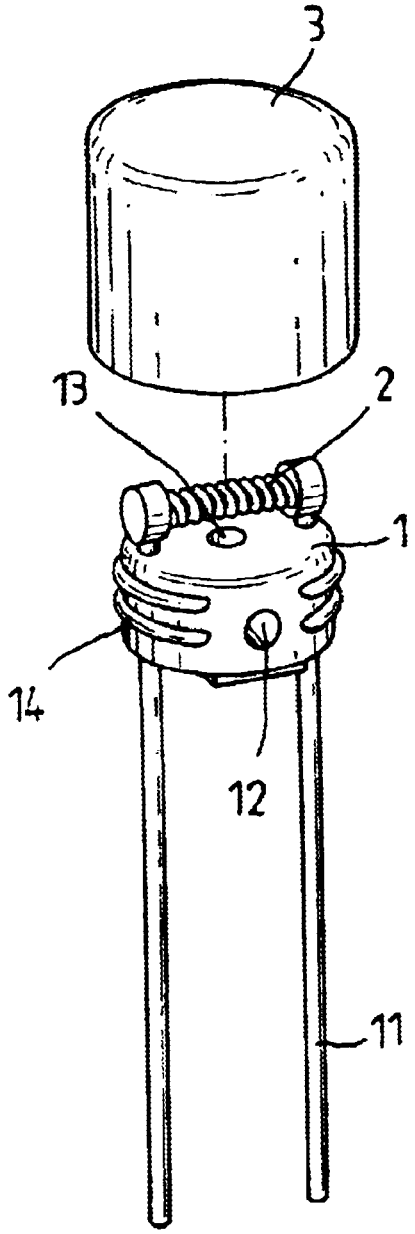
FIG. 3 shows an exploded perspective view of a fuse apparatus with explosion-proof structure according the present invention.
Figure 4:
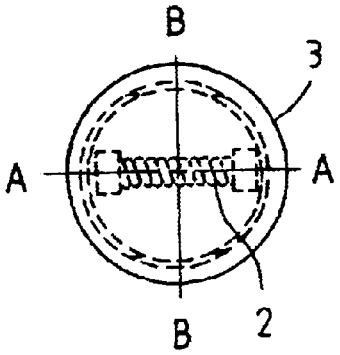
FIG. 4 shows a top plan view of the fuse apparatus of FIG. 3 being assembled.
Figure 5:
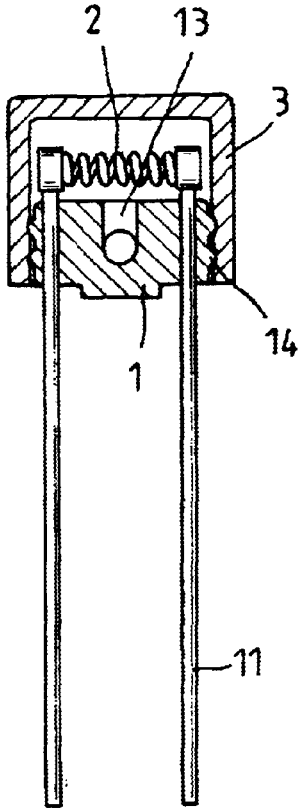
FIG. 5 shows a cross-sectional view alone line A—A of FIG. 4.
Figure 6:
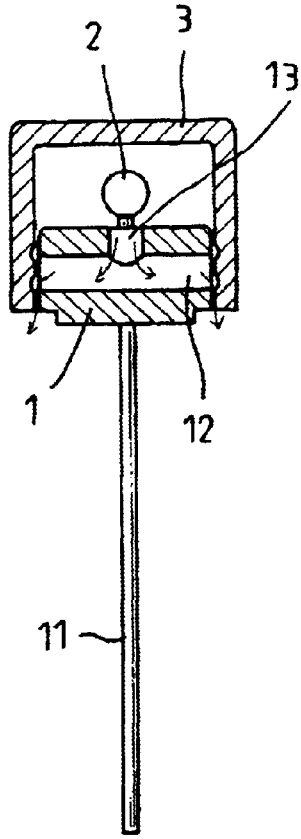
FIG. 6 shows a cross-sectional view alone line B—B of FIG. 4.

Referring to FIG. 3, the present invention includes a connector (1) connecting with two conductive legs (11), a fuse (2) mounted on the connector (1), and a cap (3) covering the connector (1), which is similar to the conventional fuse apparatus and will not be described in detail here and after. The characteristic of the invention is to provide a horizontal hole (12) and a vertical aperture (13) in the connector (1) that becomes a T-shape vent passageway at up-side-down position. The connector (1) is provided with two sets of side protrusions (14), which form a gap between the opening of the horizontal hole (12) of the connector (1) and the cap (3) when the cap (3) covers on the connector (1).

Based on the above structure, if the fuse (2) is occasionally exploded, the high pressure can be released through the vertical aperture (13) and the horizontal hole (12) and then through the gap between the connector (1) and the cap (3). Hence, the cap (3) is prevented from being broken that reaches the objective of the present invention. Meanwhile, dust or other object will not intrude into the connector (1) and affect the effectiveness of the fuse (2) easily.

What is claimed is:

1. A fuse apparatus with explosion-proof structure including a connector connecting with two conductive legs, a fuse mounted on the connector, and a cap covering the connector; the characteristic is to provide a horizontal hole and a vertical aperture in the connector that becomes a T-shape vent passageway at up-side-down position, and the connector being provided with two sets of side protrusions, which forms a gap between the opening of the horizontal hole of the connector and the cap when the cap covers on the connector.

* * * * *